US007576645B1

(12) United States Patent
Lugerner et al.

(10) Patent No.: US 7,576,645 B1
(45) Date of Patent: Aug. 18, 2009

(54) REMOTE CONTROL FINDER

(76) Inventors: Stanley Louis Lugerner, 17 Cold Springs Ct., Potomac, MD (US) 20854; Annette Rubin Bauman, 7325 Sarimento Pl., Delray Beach, FL (US) 33446

( * ) Notice: Subject to any disclaimer, the term of this patent is extended or adjusted under 35 U.S.C. 154(b) by 626 days.

(21) Appl. No.: 11/194,719

(22) Filed: Aug. 1, 2005

(51) Int. Cl.
*G08B 1/08* (2006.01)

(52) U.S. Cl. ..... 340/539.32; 340/568.1

(58) Field of Classification Search ..... 340/539.32, 340/568.1
See application file for complete search history.

(56) References Cited

U.S. PATENT DOCUMENTS

| | | | | |
|---|---|---|---|---|
| 6,445,290 | B1 * | 9/2002 | Fingal et al. | 340/539.32 |
| 6,573,832 | B1 * | 6/2003 | Fugere-Ramirez | 340/539.13 |
| 6,774,787 | B1 * | 8/2004 | Melbourne | 340/539.1 |
| 2002/0126010 | A1 * | 9/2002 | Trimble et al. | 340/568.1 |
| 2003/0058107 | A1 * | 3/2003 | Ferrier et al. | 340/571 |
| 2003/0206128 | A1 * | 11/2003 | Moore | 341/176 |
| 2006/0109112 | A1 * | 5/2006 | Haines | 340/539.32 |
| 2006/0197676 | A1 * | 9/2006 | Smith | 340/825.69 |
| 2007/0052534 | A1 * | 3/2007 | Bird et al. | 340/539.13 |
| 2007/0279245 | A1 * | 12/2007 | Sholem | 340/825.49 |

* cited by examiner

*Primary Examiner*—Jeffery Hofsass
(74) *Attorney, Agent, or Firm*—Buskop Law Group, PC; Wendy Buskop

(57) ABSTRACT

A rectangular, easy- to-hold apparatus for securing and for providing location information on a television remote within a defined space is disclosed. The disclosed apparatus and methodology discovers a rectangular device for securing a television remote with an ability to locate the remote. The apparatus further discloses a camera with memory to monitor and record images within a defined space to be used as a security or safety tool. Further, the apparatus comprises a base for storing visual or holographic images to be used as a security or genealogical tool. Further, the apparatus includes a sensor for capturing and storing television signals to allow later viewing. The apparatus can be made from a base consisting of a non-crushable solid material, such as clear plastic or decorative stone.

13 Claims, 1 Drawing Sheet

REMOTE CONTROL FINDER

FIELD

The present embodiments relate generally to an apparatus for securing and for providing location information on a television remote within a defined space. More specifically, the apparatus concerns the use of a locator signaling device, a miniature camera with memory to monitor and record images, a base for storing holographic images, and a sensor for capturing and storing of television signals for later viewing.

BACKGROUND

Television remote controls are easy to misplace within a home or a defined space. In addition, it can be difficult to locate the television remote control after it has been misplaced. Accordingly, a need exists for an easy-to-hold apparatus to secure a television remote that comprises a signaling device to enable location of the television remote control.

The monitoring of a person(s) and/or activity(ies), within a defined space can be of utmost importance (e.g., the monitoring of children as a nanny cam feature, the monitoring of the sick, the disabled, or the elderly for health or safety reasons). Accordingly, a need exists for an apparatus to monitor and record images (for example a person or an activity) within a defined space. This apparatus should comprise a miniature camera from the group of analog, digital, or a combination thereof, having a tangible means to retain and reproduce the visual data (i.e., capability of memory that can be disposed in some part of the apparatus for future use). Further, the subsequent use of the memory can be a tool for security or pleasure reasons.

The disappearance of a person presents a subsequent identification and location problem for police and other authorities as they conduct their searches in response to the person's disappearance. Searches for a person who has disappeared, for example the kidnapping of a child, are greatly enhanced when recent pictures or video of the lost person can be made available. Accordingly, a need exists for an apparatus that captures, records, and stores images, particularly holographic images, of a person that can be generally used as a tool for security as well as genealogical reasons. The apparatus should comprise a base or section of the apparatus for storing images or where holographic images can be embedded.

A need exists for an apparatus and method for censoring television programs in order to exercise viewer discretion prior to allowing the viewing by others. The apparatus should include a sensor with memory for capturing and storing of television signals to allow later viewing. For example, the apparatus will comprise a sensor that can capture television signals and allow a parent to subsequently view a particular program on a computer monitor. Accordingly, the parent can exercise their parental viewer discretion prior to their child watching that particular program. This is particularly beneficial with regard to the prevention of children watching pornographic programming.

The present embodiments meet these needs.

SUMMARY

The present embodiments relate generally to an apparatus for securing a television remote and for providing location information on a television remote for a television system within a defined space. The apparatus is rectangular in shape and easy-to-hold for securing a television remote. In addition, a signaling device is contained within the remote to enable ease of location of the television remote control.

The apparatus comprises a miniature camera with memory capabilities to monitor and record images (e.g., persons, activities) within a defined space. The apparatus comprises a hollow base which can be used for the storing and reproduction of images.

Alternatively, the base can be made of a clear plastic in which holographic images of persons, such as family members, can be embedded and used as a tool for security, genealogical or pleasure reasons. Further, the base can be solid and made from the groups consisting of various decorative stones, granite, marble, hard composite materials, or combinations thereof and with or without patterns.

Further, the apparatus includes a sensor for capturing and storing of television signals to allow later viewing, such as on a computer. This aspect is particularly beneficial with respect to having viewer discretion as to the programs being watched by children, and the ability to exclude any pornographic programs from the child's viewing.

BRIEF DESCRIPTION OF THE DRAWINGS

The detailed description will be better understood in conjunction with the accompanying drawings as follows.

Figure 1:
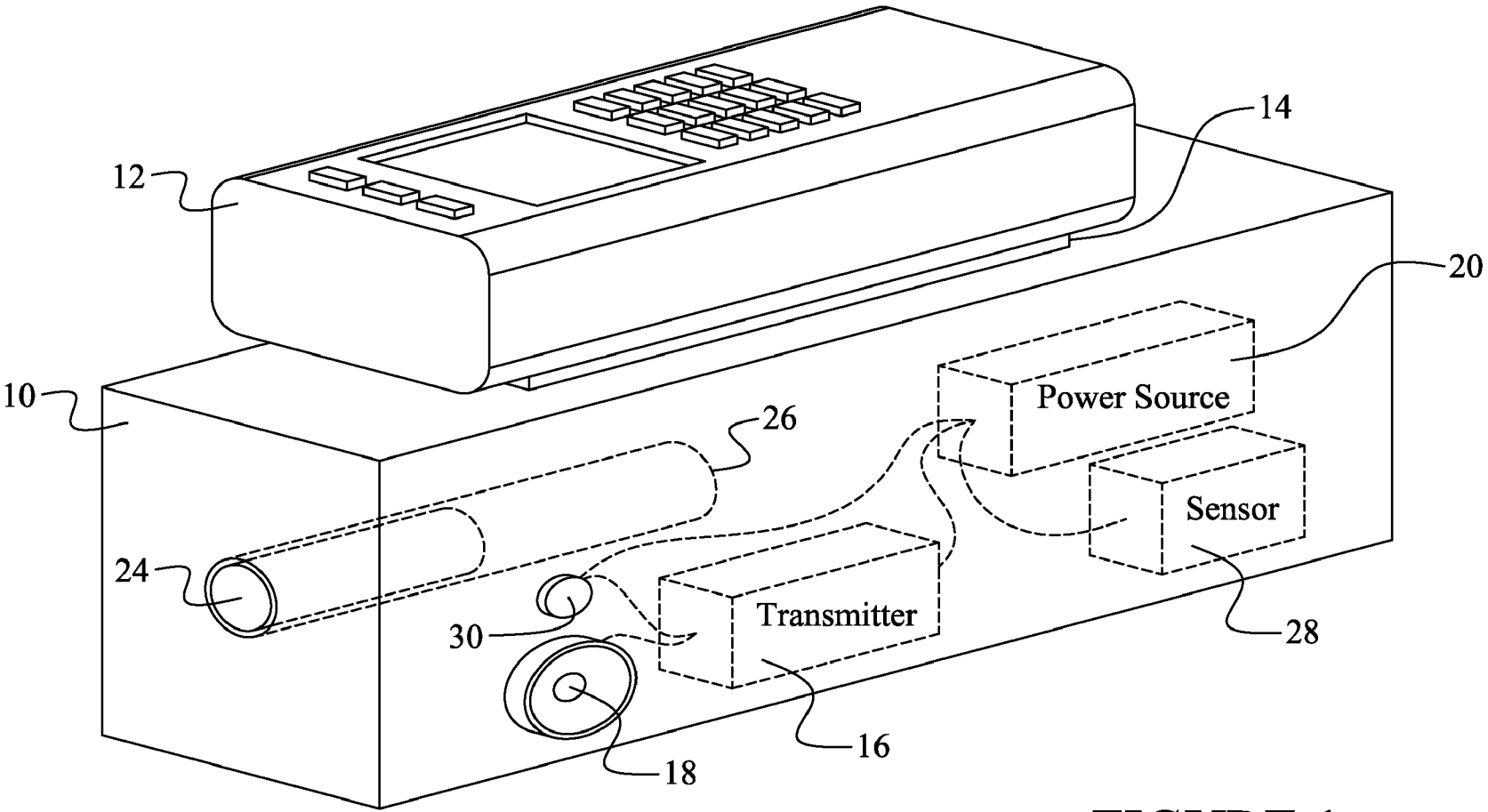
FIG. 1 depicts a side, cross sectional view of the remote control finder comprising a miniature camera.

The present embodiments are detailed below with reference to the listed FIGURE.

DETAILED DESCRIPTION OF THE EMBODIMENTS

Before explaining the present embodiments in detail, it is to be understood that the embodiments are not limited to the particular embodiments and that they can be practiced or carried out in various ways.

The present embodiments save lives by monitoring and recording persons and/or activities within a defined space for purposes that can include health and safety. In addition, lives are saved by the ability of the apparatus to capture, record, store, and reproduce camera images from memory as well as holographic images of a person, such as a family member, that can be used as a tool for security or safety reasons.

The present embodiments are made from a rectangular base consisting of a non-crushable hollow material weighing from about 0.5 pounds to 2.0 pounds. The dimensions of the base are from about 0.5 inches to 3.0 inches in height, from about 4.0 inches to 8.0 inches in length, and from about 1.0 inch to 3.0 inches in depth.

In another embodiment, the base is solid. A solid base can be made from the group consisting of granite, hard composite material, marble, a semiprecious stone, or combinations thereof. Examples of materials that can be used in the base include granite (such as from upstate New York), marble (such as from Italy), lapis lazuli as a stone, or combinations thereof. Expensive materials can be used to provide a high end, attractive base that make the base a special, precious object to be passed down from family member to family member. The materials can include patterns or not to add to the decorative look of the base.

In another embodiment, the base can be made from a clear plastic and images of family members can be embedded or laminated into the base. The holographic images of family members can be stored in or laminated into the base. Images that morph holographically can be beneficial for police work as a security tool.

The apparatus further includes the use of a removable, flexible, web-based adhesive for attaching a television remote for a digital television system to the base. Duct tape can be an embodiment of this adhesive media, but other removable web-based adhesive medias can be used, such as surgical tape or wiring tape.

A transmitter, with speaker and a power source, is embedded in the web-based adhesive for providing an auditory signal. An example of this type of transmitter is the type of transmitter generally available in an electronic store such as Radio Shack.

A remote actuator, having a frequency adapted to engage the transmitter and produce a signal upon actuation of the remote actuator, can be used to enable audio location of the television remote. This actuator can be attuned to the same frequency as the transmitter to produce the audio signal. For example, a remote actuator for car keys can be attuned to the receiver in a car so that the car starts beeping when the actuator is pressed.

The transmitter can comprise a switch and a light emitting diode (LED) coupled to the power source to enable a visual signal to be transmitted and light up the LED. This visual signal to light up the LED can be produced when the transmitter is actuated by the remote actuator.

In another embodiment, a miniature camera with memory can be disposed in the hollow base and connected to the power source and transmitter to be used as a monitor. For example, a nanny-cam can be used in order to monitor nannys watching young children at home.

Additionally, the apparatus can include a sensor for capturing the signals being watched on the television and storing those signals for later viewing, such as on a computer monitor. A particular benefit can be for prevention of assess to pornographic programming by children of a household.

The present embodiments can include methods for securing and for providing location information on a television remote within a defined space. The method involves an auditory signal and begins with embedding a transmitter into a web-based adhesive of a base. This transmitter can comprise a speaker and a power source. The next step of the methods involves using the web-based adhesive to secure a television remote to the base. The base can be constructed of a non-crushable, hollow material weighing from about 0.5 pounds to 2.0 pounds. In addition, the base can be rectangular with the dimensions of from about 0.5 inches to 3 inches in height, from about 4.0 inches to 8.0 inches in length, and from about 1.0 inch to 3.0 inches in depth. The methods continue by encoding a remote actuator to the same frequency as the embedded transmitter. Next, the remote actuator is actuated to provide a signal to the transmitter, which enables the transmitter to send a signal to the speaker to produce an auditory signal. Upon actuation of the auditory signal, the television remote, if misplaced, can be retrieved.

A remote actuator can be attuned to the same frequency as the transmitter to produce an intermittent chirping audio signal from the speaker associated with the transmitter to enable location of the television remote control upon receiving a signal from the remote actuator.

FIG. 1 depicts a base (10) which can hold a television remote (12) (or remotes) for a digital television system. A removable, flexible, web based adhesive (14) secures the television remote (12) to the base (10). A transmitter (16) with speaker (18) connected to a power source (20) is embedded in the web-based material. A remote actuator (22) can be used to engage the transmitter from a remote location.

A miniature camera (24) can be disposed in a hollow (26) of the base for monitoring.

A sensor (28) with memory can be embedded in the web-based adhesive and connected to the power source to monitor television programming of children.

An LED (30) is shown coupled to the transmitter and the power source through a switch (32) which enables a visual signal to be transmitted when the transmitter is actuated by the remote actuator (22). The LED can be disposed in the web based material and connected to the power source and transmitter. The LED (30) provides a visual cue to the user upon activation of the remote signal.

While these embodiments have been described with emphasis on the embodiments, it should be understood that within the scope of the appended claims, the embodiments might be practiced other than as specifically described herein.

What is claimed is:

1. An apparatus for securing and for providing location information on a television remote within a defined space, wherein the apparatus comprises:

a hollow base comprising a non-crushable material;

b. a removable, flexible, web-based adhesive adapted for attaching the television remote to the base;

c. a transmitter comprising a speaker and a power source, wherein the transmitter is adapted to provide an auditory signal;

d. a remote actuator adapted to engage the transmitter, wherein the transmitter provides a signal upon actuation of the remote actuator to enable audio location of the television remote; and e. a miniature camera with memory disposed in the base, wherein the miniature camera is connected to the power source.

2. The apparatus of claim 1, wherein the base is rectangular.

3. The apparatus of claim 1, wherein the base weighs from about 0.5 pounds to about 2.0 pounds.

4. The apparatus of claim 1, wherein the base dimensions range from about 0.5 inches to 3.0 inches in height, range from about 4.0 inches to 8.0 inches in length, and range from about 1.0 inch to 3.0 inches in depth.

5. The apparatus of claim 1, wherein the base is made from the group consisting of granite, hard composite material, marble, a semiprecious stone, or combinations thereof.

6. The apparatus of claim 1, wherein the base comprises a clear plastic with images, wherein the images are of family members, wherein the images are produced by holography, wherein the holographic images are disposed therein.

7. The apparatus of claim 1, further comprising a switch and an LED coupled to the transmitter and the power source which enables a visual signal to be transmitted when the transmitter is actuated by the remote actuator.

8. An apparatus for securing and providing location information on a television remote within a defined space, wherein the apparatus comprises:

a. a hollow base comprising a non-crushable material;

b. a removable, flexible, web-based adhesive adapted for attaching the television remote to the base;

c. a transmitter comprising a speaker and a power source, wherein the transmitter is adapted to provide an auditory signal; and d. a remote actuator adapted to engage the transmitter, wherein the transmitter provides a signal upon actuation of the remote actuator to enable audio location of the television remote.

9. A method for securing and for providing location information on a television remote within a defined space, wherein the method is comprising the steps of:

a. placing a transmitter with a web-based adhesive, wherein the transmitter comprises a speaker and a power source;

b. securing a television remote to a base, wherein the television remote is secured to the base with the web-based adhesive, wherein the base consists of a hollow base comprising a non-crushable material;

c. encoding a remote actuator to the same frequency as the embedded transmitter;

d. actuating the remote actuator, wherein the remote actuator provides a signal to the transmitter, wherein the transmitter is enabled by the remote actuator to provide an auditory signal;

e. retrieving the television remote upon actuation of the auditory signal; and f. providing a miniature camera with memory, wherein the miniature camera is embedded in the base, wherein the miniature camera with memory is used for monitoring, recording and storing images.

10. The method of claim 9, further comprising the step of providing a signal to the transmitter, wherein the transmitter provides an auditory signal, wherein the auditory signal is an intermittent chirping signal to enable location of the television remote control.

11. The method of claim 10, wherein the step of providing the signal to the transmitter is performed using a remote actuator.

12. The method of claim 9, further comprising the step of providing a signal to the transmitter, wherein the transmitter comprises a switch and an LED coupled to the power source, wherein the transmitter is enabled by the remote actuator to provide a visual signal to be transmitted, wherein the visual signal enables location of the television remote control.

13. A method for securing and for providing location information on a television remote within a defined space, wherein the method is comprising the steps of:

a. placing a transmitter with a web-based adhesive, wherein the transmitter comprises a speaker and a power source;

b. securing a television remote to a base, wherein the television remote is secured to the base with the web-based adhesive, wherein the base consists of a hollow base comprising a non-crushable material;

c. encoding a remote actuator to the same frequency as the embedded transmitter;

d. actuating the remote actuator, wherein the remote actuator provides a signal to the transmitter, wherein the transmitter is enabled by the remote actuator to provide an auditory signal; and e. retrieving the television remote upon actuation of the auditory signal, wherein the transmitter is in communication with a sensor with memory, wherein the sensor and the transmitter are embedded in the web-based adhesive.

* * * * *